US006227259B1

(12) United States Patent
Verclyte

(10) Patent No.: US 6,227,259 B1
(45) Date of Patent: May 8, 2001

(54) FEED GRIPPER FOR GRIPPER LOOM WITH A TUBULAR HOUSING

(75) Inventor: Eddy Verclyte, Ypres (BE)

(73) Assignee: Picanol N.V. (BE)

( * ) Notice: Subject to any disclaimer, the term of this patent is extended or adjusted under 35 U.S.C. 154(b) by 0 days.

(21) Appl. No.: 09/508,526

(22) PCT Filed: Sep. 19, 1998

(86) PCT No.: PCT/EP98/05996

§ 371 Date: Apr. 3, 2000

§ 102(e) Date: Apr. 3, 2000

(87) PCT Pub. No.: WO99/18274

PCT Pub. Date: Apr. 15, 1999

(30) Foreign Application Priority Data

Oct. 3, 1997 (BE) ..... 9700797

(51) Int. Cl.[7] ..... D03D 47/23
(52) U.S. Cl. ..... 139/448
(58) Field of Search ..... 139/448

(56) References Cited

U.S. PATENT DOCUMENTS

| | | | | |
|---|---|---|---|---|
| 3,931,837 | * | 1/1976 | Volpe | 139/448 |
| 3,934,621 | * | 1/1976 | Tosches | 139/448 |
| 4,259,997 | * | 4/1981 | Tosches | 139/448 |
| 4,587,998 | * | 5/1986 | Egloff et al. | 139/448 |

* cited by examiner

*Primary Examiner*—Andy Falik
(74) *Attorney, Agent, or Firm*—Bacon & Thomas PLLC

(57) ABSTRACT

A tubular housing is used for a gripper-loom's feed gripper. The feed gripper includes a metallic tubular housing formed of a single bent metal plate. The single bent metal plate includes at least two mutually overlapping segments that are rigidly joined to each other.

10 Claims, 5 Drawing Sheets

FEED GRIPPER FOR GRIPPER LOOM WITH A TUBULAR HOUSING

FIELD OF THE INVENTION

The invention relates to a feed gripper for a gripper loom and comprising a one piece tubular metal housing carrying at least a thread clamp.

BACKGROUND OF THE INVENTION

In gripper looms, a feed gripper accepts a filling yarn kept ready at one side of a shed and then inserts it into this shed. In accordance with one example, the feed gripper moves the filling approximately into the shed center. There the filling is transferred to a receiving gripper and moved to the opposite shed side. In another example, the feed gripper moves the filling to the opposite shed side where it is transferred to a stationary gripper. The feed gripper is mounted to the front end of a rapier which can be inserted into and then be withdrawn from the shed and which drives the feed gripper and moves it into the shed.

A feed gripper of the above kind is known from the British patent 1,487,897. Two bent and mutually articulating metal plates constitute a tubular housing. The feed gripper is fitted at one or both sides with two cooperating clamp elements for each filling. These clamp elements each are mounted on one of the two mutually connected metal plates.

In another example of a known gripper loom as disclosed in the French patent 2,132,560, a gripper head mounted on a gripper rod is described, and which comprises a tubular housing constituted of an integral plate. This gripper head contains no thread clamp and pulls a looped thread into a shed, one end of said loop being held in place. At the center of the shed, the loop is transferred to another gripper which then pulls the free filling end through the shed.

BRIEF SUMMARY OF THE INVENTION

The objective of the invention is to improve a feed gripper for a gripper loom. This objective is achieved by forming the housing of a metal plate and of at least two mutually overlapping segments rigidly joined to each other.

This design thus creates a closed and hollow structure offering a comparatively high dimensional stability even if a relatively thin metal plate is used.

In a further embodiment of the invention, the mutually overlapping segments provide supports for one or more components. Because in this region of overlap the gripper housing wall thickness is doubled, the component(s) is (are) reliably held in place even in the presence of applied forces.

In another embodiment of the invention, the supported component is affixed by least one screw passing through the overlapping segments and connecting hem to each other and to the component. The resultant design is very simple because assembly of the component simultaneously firmly joins the overlapping segments of the housing firmly to each other.

DESCRIPTION OF THE DRAWINGS

Further features and advantages of the invention are elucidated in the following description of the embodiments that are shown in the drawings, herein.

DETAILED DESCRIPTION

Figure 1:
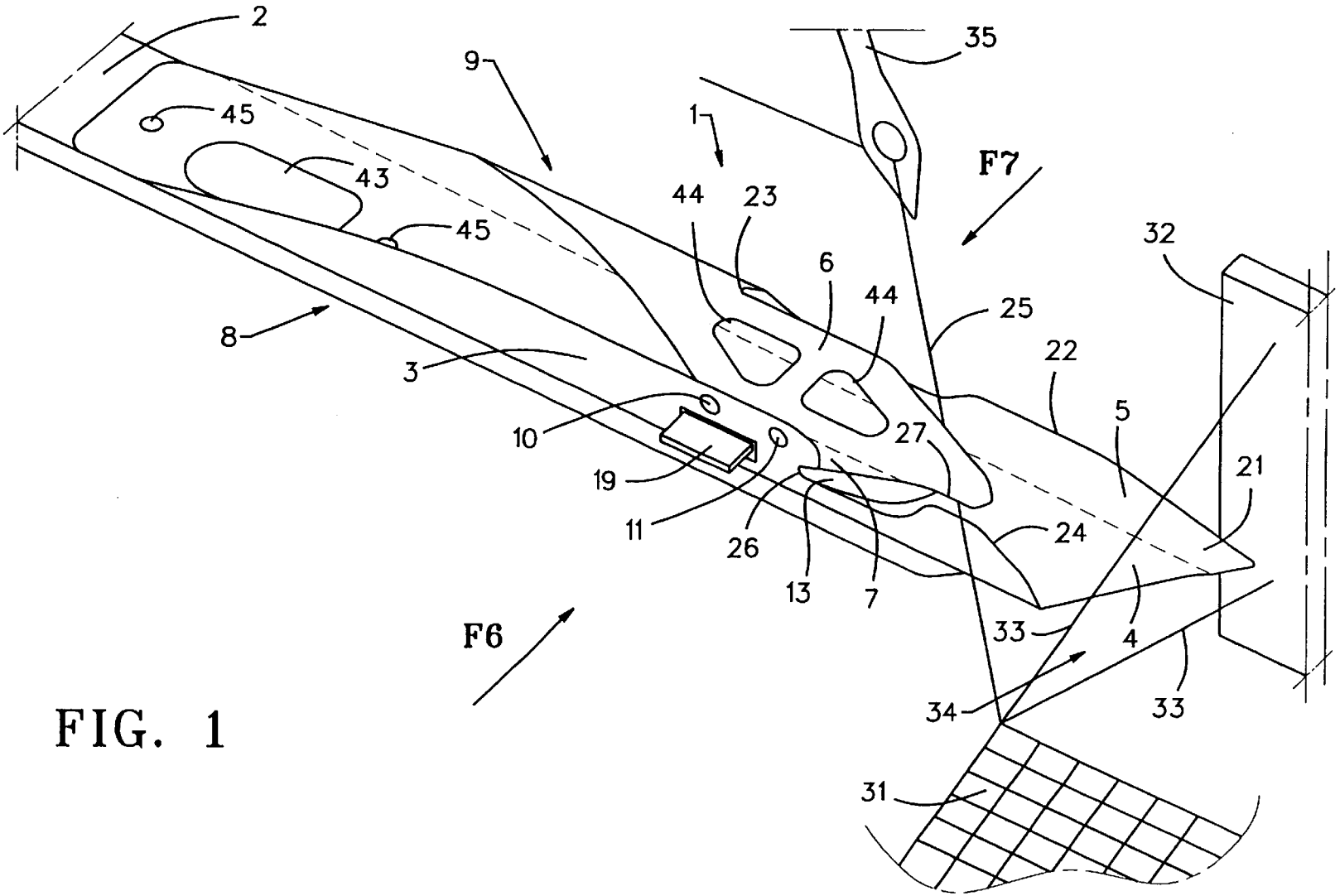
FIG. 1 is a perspective of a feed gripper of the invention.
Figure 7:
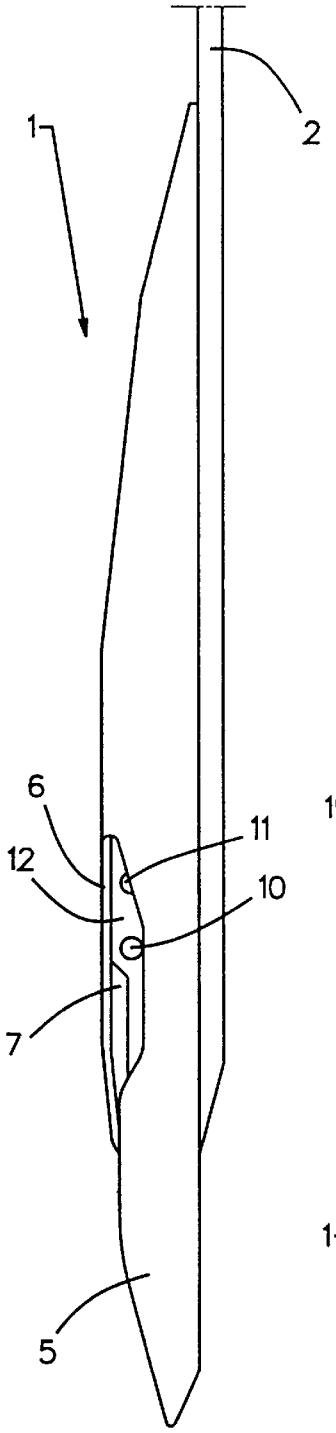
FIG. 7 is a front view of the feed gripper in the direction of the arrow F7 of FIG. 1.
Figure 2:
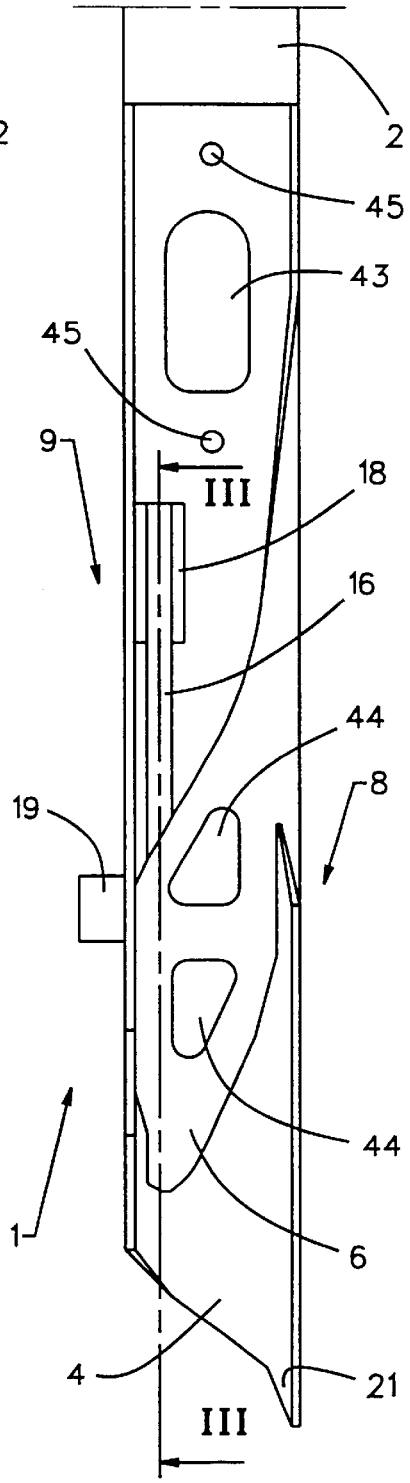
FIG. 2 is a topview of the feed gripper of FIG. 1.
Figure 6:
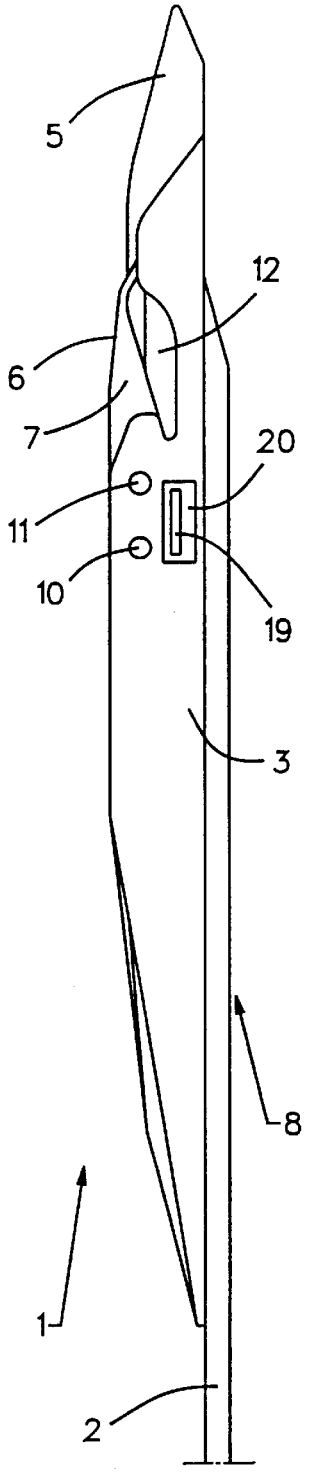
FIG. 6 is a front view of the feed gripper in the direction of the arrow F6 of FIG. 1.
Figure 3:
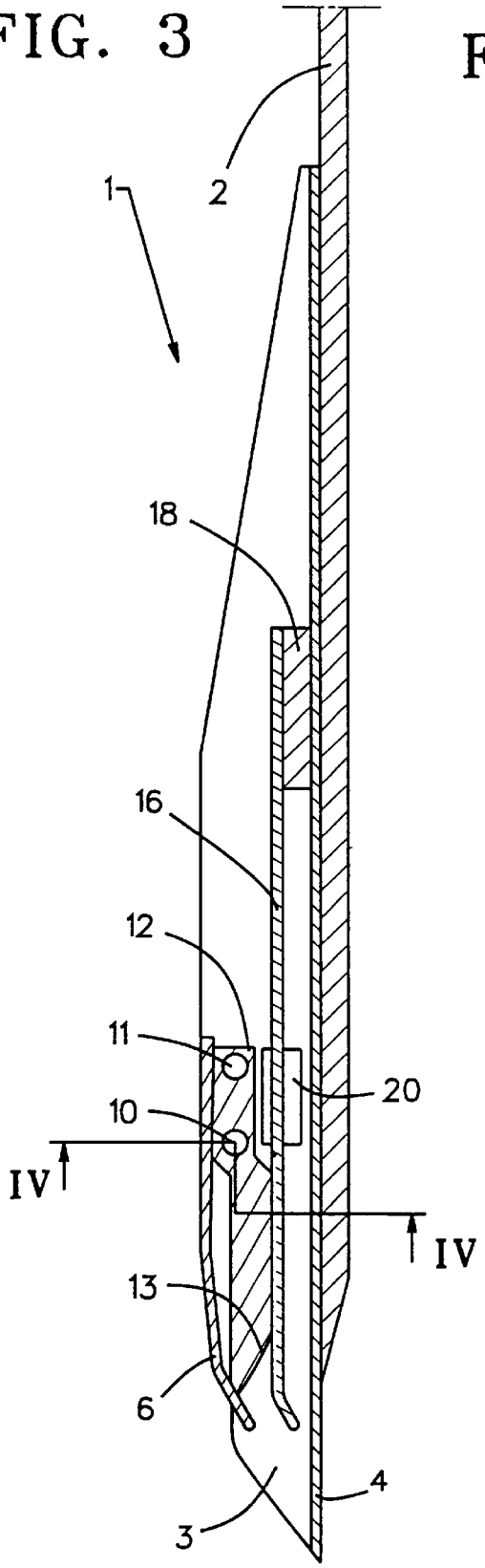
FIG. 3 is a section along line IIII—IIII of FIG. 2 in simplified form.
Figure 5:
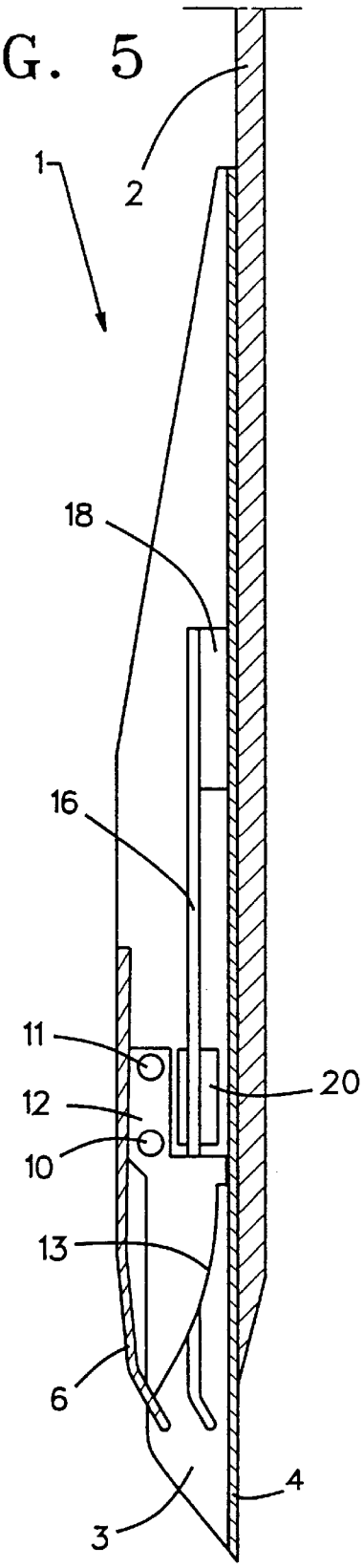
FIG. 5 is a section along line V—V of FIG. 4 in simplified form.

The gripper-loom feed gripper 1 shown in FIGS. 1 through 7 inserts a filling 25 in a shed 34 formed of warp threads 33. In known manner, the feed gripper 1 is affixed for instance by screws 45 to the front end of a rapier 2. The rapier 2 is inserted into the shed 34 in a known manner and then is retracted from it, as a result of which the feed gripper 1 is correspondingly moved into and out of the shed 34.

The feed gripper 1 comprises a tubular housing having segments 3, 4, 5, 6 and 7 which are part of an integral and bent metal plate. At one side wall 8, the housing comprises two mutually overlapping segments 3 and 7, further a segment 4 forming the base, and also a segment 5 forming the opposite side wall 9 and a segment 6 forming the top side. Illustratively, the metal plate may be constituted of bent steel or of a bent light-alloy, for instance an aluminum alloy. During loom operation, the first side wall 8 which comprises the two mutually overlapping segments 3 and 7, illustratively will be situated on the side opposite the fabric 31, whereas the other side wall 9 faces a reed 32 of the gripper loom. The front-most end 21 of the feed gripper I in the region of the side wall 9 therefore is also situated on the side facing the reed 32. The segments 4 and 6 of this illustrative embodiment comprise clearances 43 and 44.

The two overlapping segments 3, 7 support a brace element 12. Two screws 10, 11 pass through the two overlapping segments 3, 7 and are screwed into the brace element 12. As a result, on one hand the brace element 12 is affixed to the feed gripper 1 and on the other hand the two overlapping segments 3, 7 are firmly joined to each other. The segment 7, which extends from the segment 6 forming the top side, is situated between the brace element 12 and the segment 3 which is bent off the segment 4 of the feed gripper I forming the base.

The brace element 12 is fitted with a filling-thread guide 13, for example, formed integral with the brace element 12. The guide 13 starts at about one third the height of the feed gripper 1 and terminates in the zone of base-forming segment 4 at a stop 14.

Furthermore, by means of its underside, the brace element 12 constitutes a stationary clamp element 15 for the filling 25. The feed gripper 1 also includes a movable clamp element 16 cooperating with the stationary clamp element 15 to clamp a filling 25.

The movable clamp element 16 is affixed by an intermediate strip 18 to the base-forming segment 4 of the feed gripper 1. Illustratively, such affixation may be by bonding. The movable clamp element 16 is in the form of a leaf spring and by way of example is formed of steel and is mounted in such manner in the feed gripper 1 that it is biased against the stationary clamp element 15. The movable, leaf-spring type clamp element 16 is fitted with a stop 19 situated in the area of the brace element 12 and projects outward through an aperture 20 of the segment 3. When at the level of the stationary clamp element 15, the movable clamp element 16 can be moved by the stop 19 away from said stationary clamp element 15 in order to open the filling clamp 17 consisting of the clamp elements 15 and 16. The thread clamp 17 is situated in the vicinity of that side wall 8 of the feed gripper 1 which faces towards the fabric 31. The stop 19 cooperates in known manner with other stop elements, not shown, the feed gripper 1 running in such manner along these other stop elements that the stop 19 shall be displaced so as to open the thread clamp 17.

A filling 25 kept ready between a fabric 31 and a feed element 35 is transferred in known manner to the feed gripper 1. During forward motion of the feed gripper 1, the filling is advanced, as indicated in FIG. 1, along a guide 22 of the segment 5 as far as a stop 23. At the same time the filling 25 is guided by means of the guide 24 of the segment 3, by means of the guide 27 of the segment 6 and by means of the underside of the guide element 13 as far as the stop of this guide element 13 and to a stop 26 situated in the segment 3. Illustratively, the filling 25 subtends, between the stop 14 of the guide element 13 and the stop 23 of the segment 5, an angle of about 50° with the base-forming segment 4. Moreover the filling 25 is clamped between the clamp elements 15 and 16 of the thread clamp 17, said elements being situated between the stop 14 of the guide element 13 and the stop 26 of the segment 3. Once the filling 25 has been clamped, it will be cut by a thread scissors (not shown) from the fabric 31 and thereupon it is moved further by the feed gripper 1 into the shed 34. During this procedure the filling 25 is taken off a supply device (not shown), in particular a pre-winder.

The movable clamp element 16 exerts a force on the stationary clamp element 15 which is transmitted to the brace 12 and from the latter into the housing of the feed gripper 1. By means of the guide element 13, the stop 14 and the thread clamp 17, the filling 25 also exerts a force on the brace element 12 transmitted to the housing of the feed gripper 1. The tubular or boxy shape of the housing of the feed gripper 1 and the affixation of the brace element 12 to two mutually overlapping segments 3, 7 offer the advantage that the housing is easily able to absorb forces transmitted to it and shall be only slightly deformed by them. As a result the metal plate thickness of the housing can be kept low or a thin, light alloy can be used to form the housing.

Figure 8:
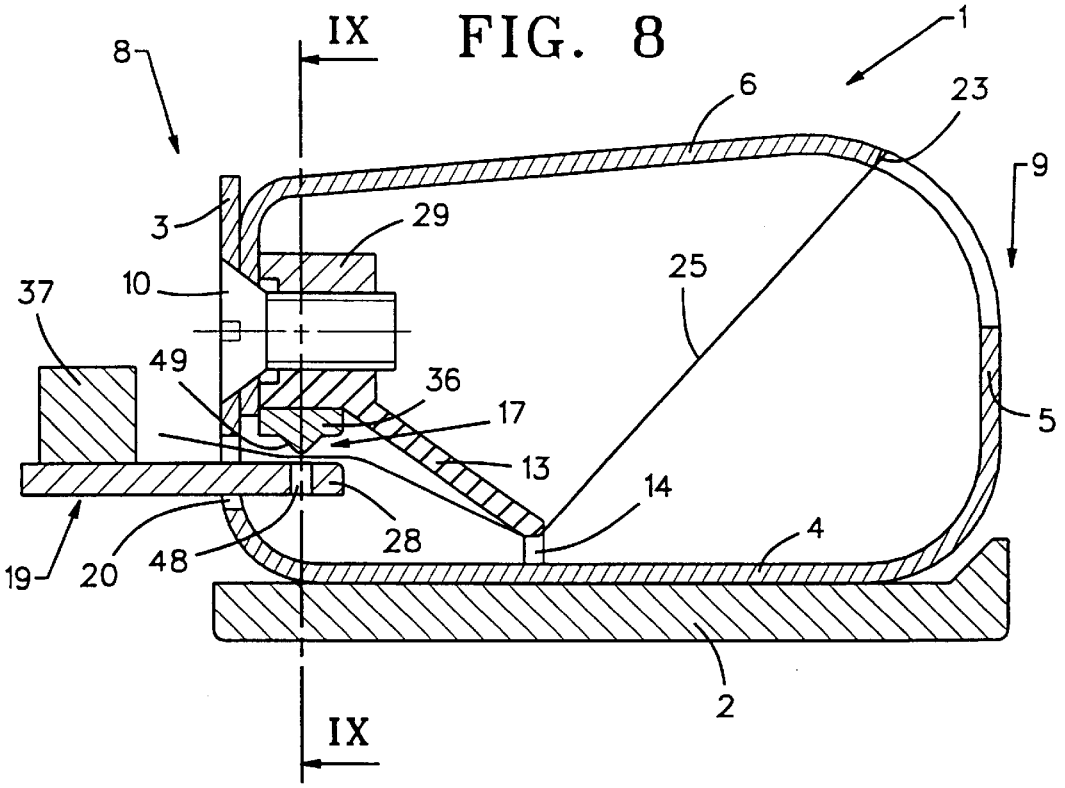
FIG. 8 is an embodiment variation similar to FIG. 3 with an opened thread clamp.
Figure 4:
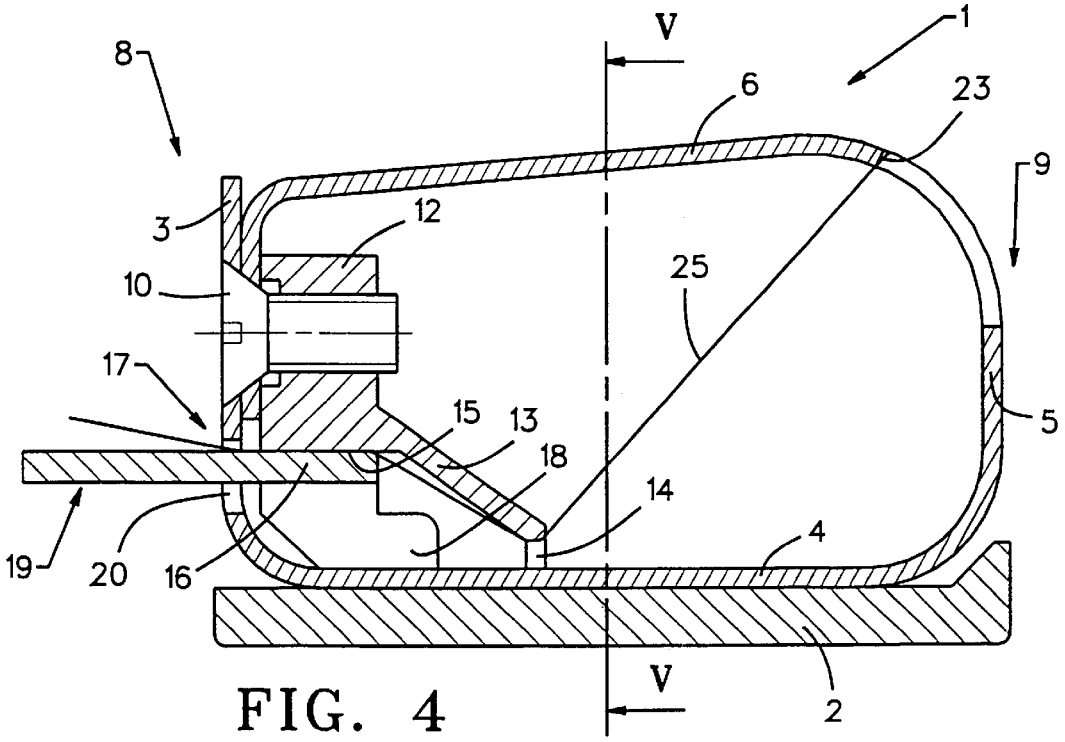
FIG. 4 is a section along line IV—IV of FIG. 3 in simplified form.
Figure 9:
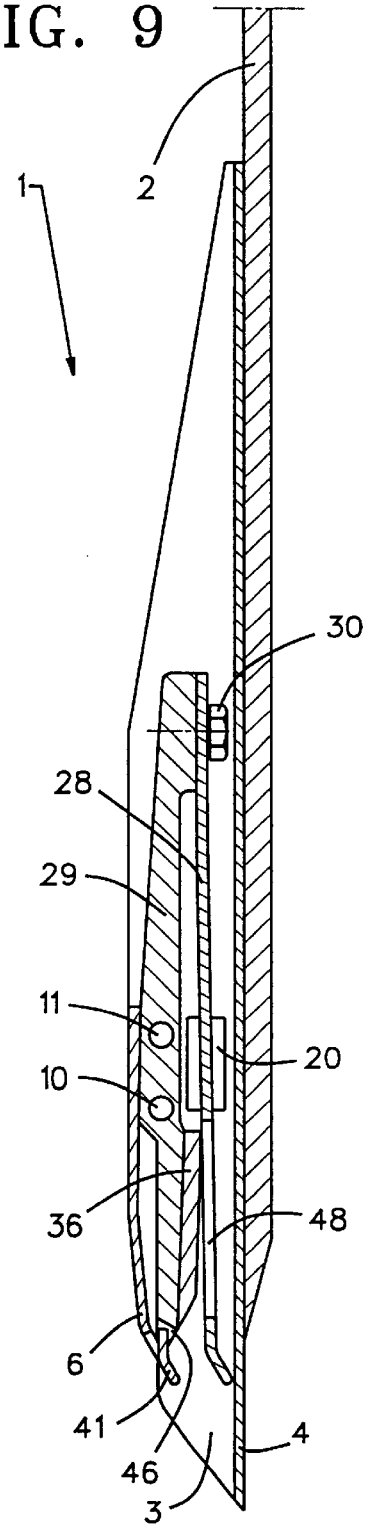
FIG. 9 is a section along line IX—IX of FIG. 8.

FIGS. 8 and 9 show an embodiment wherein a movable clamp element 28 is affixed to a brace element 29 which in turn is affixed to the two mutually overlapping segments 3, 7 of the housing. For that purpose, the brace element 29 is extended in the longitudinal direction of the feed gripper 1. The movable clamp element 28 is fastened at its end by a screw 30 to the brace element 29. A clamp element 36 is fastened, for instance by bonding, to the brace element 29. This clamp element 36 is fitted with a V-shaped rib 49 running in its longitudinal direction and cooperating with a slot 48 in the movable clamp element 28. The embodiment of FIGS. 8 and 9 differs from that of FIGS. 1 through 7 in that the movable clamp element 28 shall exert a force on the brace element 29 to be transmitted into the gripper's case only when the clam element 28 is driven by its stop 19. The stop 19 is controlled by stop device 37 diagrammatically shown in FIG. 8 and mounted next to the feed gripper 1, for instance in the zone of known, but (not shown) guides for the rapier 2. Obviously, the feed-gripper housing is equally able to absorb forces. A lip-shaped element 41 is stamped into the front end of the segment 6. A slot 46 is present at the front end of the guide 13 and receives the lipshaped element 41. This feature assures that a filling always shall be guided along the guide element 13 and hence shall preclude a filling from wandering between the brace element 12 and the segment 6.

Figure 10:
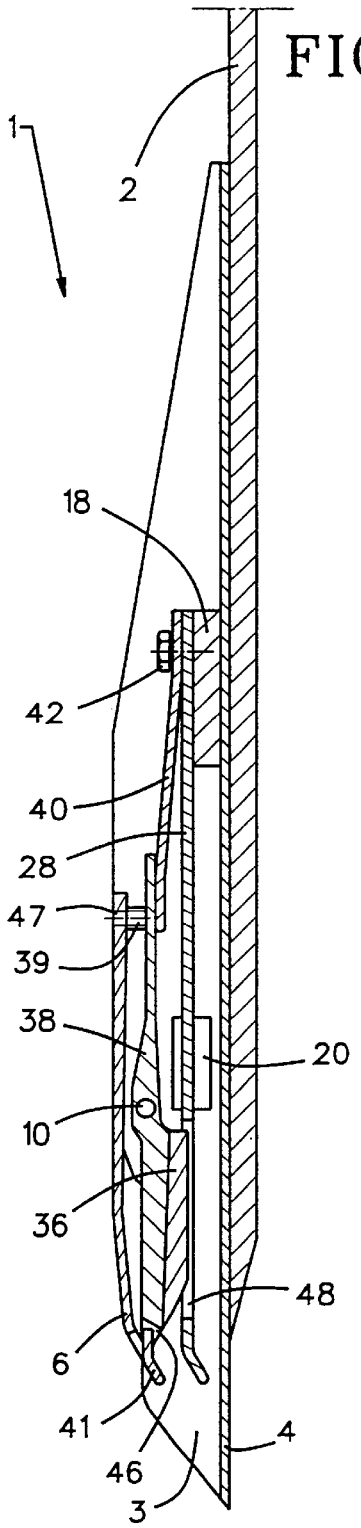
FIG. 10 is an embodiment similar to that shown in FIG. 9 with a closed thread clamp.

As regards the embodiment of FIG. 10, an adjusting screw 39 is provided at the brace element 38 and cooperates with the segment 6 of the feed gripper 1. An aperture is present in the segment 6 and allows toolaccess to the adjusting screws 39. The brace element 38 is loaded by a spring 40 which forces the brace element 38 with the adjusting screw 39 against the segment 6. The leaf spring 40 is affixed at one end in the vicinity of the movable clamp element 28 to the segment 4. Together with the end of the clamp element 28, the end of the spring 40 is fastened by a screw 20 to a spacer 18 illustratively bonded to the segment 4. The other end of the spring 40 loads the brace element 38. In this embodiment the brace element 38 can be moved into a predetermined angular position, whereupon the screw 10 shall be tightened in order to affix the brace element 38 in this angular position relative to the two overlapping segments 3, 7. In this way the brace element 38 can be moved into a predetermined angular position as a function of the characteristics of the filling 25 to be clamped. Because thereby the position of the guide 13 also is changed, the lip-shaped element 41 entering the slot 46 is advantageously adjusted.

The invention is not restricted to the illustrative embodiments described above and shown in the Figures. Instead further and different designs are easily conceivable by those skilled in the art. For instance the metal plate of the housing need not be one-piece, but may consist of several assembled parts. The protection for the invention is to be determined solely by the attached claims.

What is claimed is:

1. A feed gripper for a gripper loom, said feed gripper comprising:

a metallic tubular housing, said tubular housing carrying a thread clamp, said tubular housing formed of a single bent metal plate having at least two mutually overlapping segments, the at least two mutually overlapping segments rigidly joined to each other.

2. The feed gripper as claimed in claim 1, wherein the mutually overlapping segments define a side wall of said housing.

3. The feed gripper as claimed in claim 1, wherein the mutually overlapping segments define an integral support for at least one component.

4. The feed gripper as claimed in claim 3, including at least one threaded fastener fastening the overlapping segments to each other and to the component.

5. The feed gripper as claimed in claim 3, wherein the component includes a guide configured for positioning a filling thread inside the housing.

6. The feed gripper as claimed in claim 3, wherein the component includes a clamp element for a filling.

7. The feed gripper as claimed in claim 6, including a movable clamp element associated with a stationary clamp element.

8. The feed gripper as claimed in claim 7, wherein the movable element is biased against the component.

9. The feed gripper as claimed in claim 3, including an adjusting device carried by the housing and connected to the components so that the position of the component is adjustable relative to the housing.

10. The feed gripper as claimed in claim 7, wherein the movable clamp element is fitted with a stop projecting outward through an opening in the side wall of the housing.

* * * * *